US007887058B2

(12) United States Patent
Ritter et al.

(10) Patent No.: US 7,887,058 B2
(45) Date of Patent: Feb. 15, 2011

(54) METHODS OF PLAYING DRAWING GAMES AND ELECTRONIC GAME SYSTEMS ADAPTED TO INTERACTIVELY PROVIDE THE SAME

(75) Inventors: Janice Ritter, Los Angeles, CA (US); Peter Maciver, Huntington Beach, CA (US); Gary Collins, Redondo Beach, CA (US); Brian Yu, Los Angeles, CA (US)

(73) Assignee: Mattel, Inc., El Segundo, CA (US)

( * ) Notice: Subject to any disclaimer, the term of this patent is extended or adjusted under 35 U.S.C. 154(b) by 70 days.

(21) Appl. No.: 11/427,626

(22) Filed: Jun. 29, 2006

(65) Prior Publication Data

US 2007/0018393 A1 Jan. 25, 2007

Related U.S. Application Data

(60) Provisional application No. 60/697,436, filed on Jul. 7, 2005, provisional application No. 60/731,060, filed on Oct. 27, 2005, provisional application No. 60/792,180, filed on Apr. 13, 2006.

(51) Int. Cl.
*A63F 3/00* (2006.01)

(52) U.S. Cl. ..... 273/249; 273/273; 463/9

(58) Field of Classification Search ..... 273/249, 273/272, 273, 275, 432; 463/9
See application file for complete search history.

(56) References Cited

U.S. PATENT DOCUMENTS

| | | | |
|---|---|---|---|
| 2,280,609 | A | 9/1939 | Williamson |
| 4,353,552 | A | 10/1982 | Pepper, Jr. |
| 4,588,187 | A | 5/1986 | Dell |
| 4,695,953 | A | 9/1987 | Blair et al. |
| 4,758,691 | A | 7/1988 | De Bruyne |

(Continued)

FOREIGN PATENT DOCUMENTS

| | | | |
|---|---|---|---|
| WO | 2004075004 | A2 | 9/2004 |

OTHER PUBLICATIONS http://pictionary.play-games-online.org/pictionary-rules.html.*

(Continued)

*Primary Examiner*—Vishu K. Mendiratta
(74) *Attorney, Agent, or Firm*—Cantor Colburn LLP

(57) ABSTRACT

Methods of playing drawings games incorporating novel steps and electronic game systems configured for use with a video display and adapted to interactively provide novel methods of playing drawing games. Novel steps of the methods include: providing an award based at least in part on the number of continuous lines used by a player in the drawing of clues; erasing a player's drawing after a predetermined time in sequence to how the drawing was sketched; providing an initial image to a player who sketches clues incorporating the initial image to create a drawing; limiting a player's sketch to a combination of a predetermined set of shapes; limiting a player's sketch to clues not depicting the physical manifestation of the word provided; manipulating a hand, wrist, or arm of a player to sketch clues to a word; requiring the player sketching clues to continuously produce verbal sound; requiring the player sketching clues to continuously keep his/her feet off the floor; and requiring the player sketching the clues to sketch upside-down.

20 Claims, 10 Drawing Sheets

U.S. PATENT DOCUMENTS

| | | | | |
|---|---|---|---|---|
| 4,782,335 | A | 11/1988 | Gussin | |
| 4,846,693 | A | 7/1989 | Baer | |
| 4,927,147 | A * | 5/1990 | Delzio | 273/146 |
| RE33,662 | E | 8/1991 | Blair et al. | |
| 5,088,928 | A | 2/1992 | Chan | |
| 5,174,759 | A | 12/1992 | Preston et al. | |
| 5,178,545 | A | 1/1993 | Thompson | |
| 5,239,464 | A | 8/1993 | Blair et al. | |
| 5,311,207 | A | 5/1994 | Kusumoto et al. | |
| 5,453,758 | A | 9/1995 | Sato | |
| 5,511,983 | A | 4/1996 | Kashii et al. | |
| 5,594,215 | A | 1/1997 | Jeng | |
| 5,607,160 | A | 3/1997 | Stevens et al. | |
| 5,670,992 | A | 9/1997 | Yasuhara et al. | |
| 5,855,483 | A | 1/1999 | Collins et al. | |
| 5,915,003 | A * | 6/1999 | Bremer et al. | 379/93.19 |
| 5,963,199 | A | 10/1999 | Kato et al. | |
| 5,967,898 | A | 10/1999 | Takasaka et al. | |
| 6,191,777 | B1 | 2/2001 | Yasuhara et al. | |
| 6,201,947 | B1 | 3/2001 | Hur et al. | |
| 6,244,960 | B1 | 6/2001 | Takasaka et al. | |
| 6,279,909 | B1 | 8/2001 | Alexander, II et al. | |
| 6,607,437 | B2 | 8/2003 | Casey et al. | |
| 6,645,070 | B2 | 11/2003 | Lupo | |
| 6,756,965 | B2 | 6/2004 | Combs et al. | |
| 6,761,356 | B1 | 7/2004 | Jacobson et al. | |
| 6,878,062 | B2 | 4/2005 | Bjorklund et al. | |
| 2002/0090993 | A1 | 7/2002 | Koshiro et al. | |
| 2003/0022717 | A1 | 1/2003 | Bjorklund et al. | |
| 2005/0051957 | A1 * | 3/2005 | Rice-Lincoln | 273/243 |
| 2005/0184461 | A1 | 8/2005 | Cogliano et al. | |
| 2007/0045963 | A1 * | 3/2007 | Hampton et al. | 273/300 |
| 2007/0213111 | A1 * | 9/2007 | MacIver et al. | 463/9 |

OTHER PUBLICATIONS

Pictionary rules (2 pages attached as shown on website).*
iSketch.net screen shots.
Milton Bradley Pictionary Rules. 15th Anniversary, 2000.
Milton Bradley Pictionary Instructions, 1993.
Milton Bradley Pictionary Rules, 2000.
Milton Bradley Pictionary Junior Rules. 1999.
Milton Bradley Pictionary Junior Rules, 1993.
Spears/Mattel Don't Panic Instructions, 1996.
Mattel Disney Charades Instructions, 1999.
An International Search Report from related International Application No. PCT/US06/25649, mailed Jun. 24, 2008.

* cited by examiner

METHODS OF PLAYING DRAWING GAMES AND ELECTRONIC GAME SYSTEMS ADAPTED TO INTERACTIVELY PROVIDE THE SAME

This application is based upon and claims priority under 35 U.S.C. §119(e) to U.S. Provisional Application Ser. No. 60/697,436, entitled "Interactive Electronic Drawing Game," filed on Jul. 7, 2005, U.S. Provisional Application Ser. No. 60/731,060, entitled "Drawing and Pantomine Guessing Game," filed on Oct. 27, 2005, and U.S. Provisional Application Ser. No. 60/792,180, entitled "Drawing and Pantomine Guessing Game," filed on Apr. 13, 2006, the entire contents of which are hereby incorporated by reference for all purposes.

BACKGROUND

The present disclosure relates generally to drawing games, and more particularly to methods of playing drawing games and electronic game systems incorporating electronic drawing input devices and adapted to interactively provide the methods of playing drawing games.

Games such as PICTIONARY® and WIN LOSE OR DRAW™ have been enjoyed for years by players in both the parlor and TV game show settings. These traditional drawing games have historically used paper tablets and writing utensils for players to sketch clues to a word or phrase in play. A teammate (or teammates) of the sketcher then attempts to guess the word or phrase in play to score points or advance on a game board. Examples of drawing games are disclosed in U.S. Pat. Nos. 4,927,147, 6,279,909, and 6,761,356, the disclosures of which are hereby incorporated by reference in their entirety for all purposes.

Electronic drawing input devices have been used in conjunction with personal computers to allow users to create digital drawings. For example, keyboards, joy-sticks, mice, game-pads, and tablets may be connected to a personal computer and used to input drawings with software such as MICROSOFT® Paint. Tablets, or graphic tablets, are a type of computer input device that allows a user to create hand-drawn images. They generally consist of a flat surface upon which a user applies pressure with a stylus or other generally pointed pen-like apparatus. Examples of electronic drawing input devices are disclosed in U.S. Pat. Nos. 5,511,983, 4,758,691, 5,594,215, 5,453,758, and 5,963,199, the disclosures of which are hereby incorporated by reference in their entirety for all purposes.

Electronic drawing input devices have been used in conjunction with personal computers and game consoles for the playing of electronic drawing games. NINTENDO ENTERTAINMENT SYSTEM's® (NES®) PICTIONARY® released by LJN™ in 1990 and the online game iSketch™ found at http://www.isketch.net/ are two such examples.

Other examples of games utilizing electronic inputs are disclosed in U.S. Pat. App. Pub. No. 2003/0022717 and U.S. Pat. Nos. 5,178,545, 6,607,437, 6,645,070, 5,239,464, 5,967,898, 4,695,953, Re. 33,662, and 5,174,759, the disclosures of which are hereby incorporated by reference in their entirety for all purposes.

SUMMARY

Novel methods of playing drawing games are provided. The methods of may be played individually or as rounds of a multi-faceted game.

One method comprises providing a word to a first player; initiating a timer; sketching, by the first player, clues to the word to create a drawing while a second player, observing the drawing, attempts to identify the word; and providing an award based at least in part on the number of continuous lines used by the first player in the drawing of the clues and on whether the second player correctly identifies the word before the timer runs to a predetermined time.

A second method comprises providing a first player with a word; initiating a timer; sketching, by the first player, clues to the word to create a drawing, the drawing being limited to a combination of a predetermined set of shapes while a second player, observing the drawing, attempts to identify the word; and providing an award based at least in part on whether the second player correctly identifies the word before the timer runs to a predetermined time.

A third method comprises providing a word to a first player; initiating a timer; sketching, by the first player, clues to the word to create a drawing, the drawing being limited to clues not depicting the physical manifestation of the word while a second player, observing the drawing, attempts to identify the word; and providing an award based at least in part on whether the second player correctly identifies the word before the timer runs to a predetermined time.

A fourth method comprises providing a word to a first player; initiating a timer; while continuously producing verbal sound, sketching, by the first player, clues to the word to create a drawing while a second player, observing the drawing, attempted to identify the word; and providing an award based at least in part on whether the second player correctly identifies the word before the timer runs to a predetermined time.

A fifth round comprises providing a word to a first player; initiating a timer; sketching, by the first player while continuously holding his/her feet off the floor, clues to the word to create a drawing while a second player, observing the drawing, attempts to identify the word; and providing an award based at least in part on whether the first player successfully keeps his/her feet off the floor and the second player correctly identifies the word before the timer runs to a predetermined time;

A sixth round comprises providing a word to a first player; initiating a timer; sketching, by the first player, upside-down clues to the word to create a drawing while a second player, observing the drawing, attempts to identify the word; and providing an award based at least in part on whether the second player correctly identifies the word before the timer runs to a predetermined time;

A seventh method comprises providing a first word to a first player; initiating a timer; sketching, by the first player, clues to the first word to create a first drawing while a second player, observing the first drawing, attempts to identify the first word; providing a second word to the first player; sketching, by the first player, clues to the second word to create a second drawing while the second player, observing the second drawing, attempts to identify the second word; and providing an award based at least in part on the number of words correctly identified by the second player before the timer runs to a predetermined time.

An eighth method comprises providing a word to a first player; initiating a timer; sketching, by the first player, clues to the word to create a drawing while a second player, observing the drawing, attempts to identify the word; erasing the drawing after a first predetermined time in sequence to how the drawing was drawn; and providing an award based at least in part on whether the second player correctly identifies the word before the timer runs to a second predetermined time.

A ninth method comprises providing a word to a first player; initiating a timer; providing an initial image to the first player; sketching, by the first player, clues to the word to create a drawing incorporating the initial image while a second player, observing the drawing, attempts to identify the word; and providing an award based at least in part on whether the second player correctly identifies the word before the timer runs to a predetermined time.

A tenth method comprises providing a word to a first player; initiating a timer; sketching, by the first player, clues to the word to create a first drawing while a second player, observing the first drawing, attempts to identify the word; sketching, by a third player, additional clues to the word to create a second drawing incorporating the first drawing while the second player, observing the second drawing, attempts to identify the word; and providing an award based at least in part on whether the second player correctly identifies the word before the timer runs to a predetermined time.

An eleventh method comprises providing a first word and a second word to a first player; initiating a timer; sketching, by the first player, clues to the first word to create a first drawing while a second player, observing the first drawing, attempts to identify the first word; upon the second player correctly identifying the first word, sketching, by the first player, clues to the second word to create a second drawing while the second player, observing the second drawing, attempts to identify the second word; and providing an award based at least in part on whether the second player correctly identifies the first word and the second word before the timer runs to a predetermined time.

A twelfth method comprises providing a word to a first player; initiating a timer; sketching, by the first player manipulating a hand, wrist, or arm of a second player, clues to the word to create a drawing while the second player or a third player, observing the drawing, attempts to identify the word; and providing an award based at least in part on whether the second or third player correctly identifies the word before the timer runs to a predetermined time.

In addition, board games and electronic game systems adapted to interactively provide novel methods of playing drawing games are provided. In some embodiments, the electronic game systems are configured for use with a video display and comprise a tablet and stylus configured to receive user input including input drawings. The system is adapted to output video data to the video display including output drawings corresponding to the input drawings.

DETAILED DESCRIPTION

Figure 1:
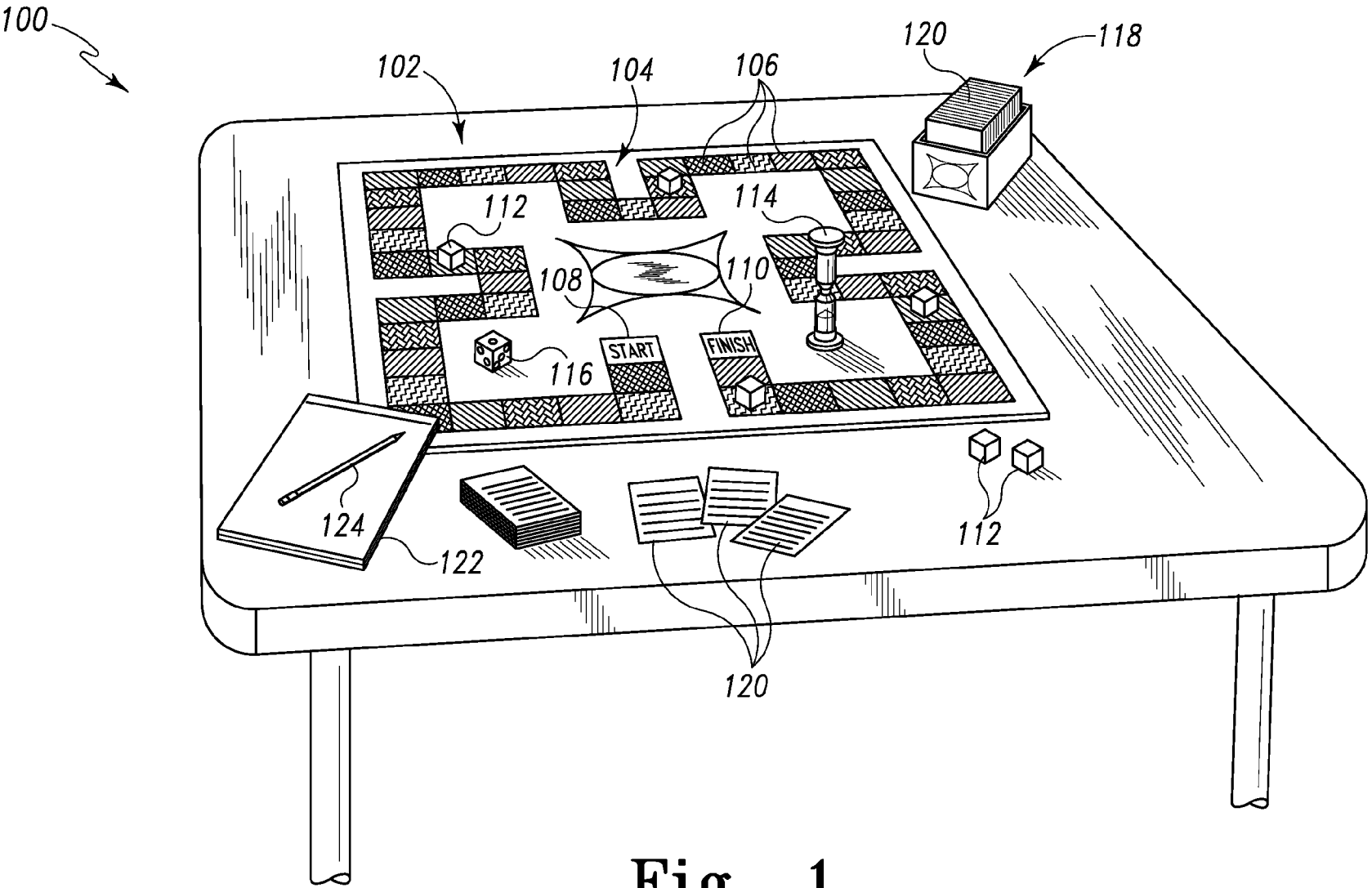
FIG. 1 is an isometric view of a board game for use with methods of playing drawing games.

Referring initially to FIG. 1, a non-exclusive illustrative example of a board game 100, including its various components, which may be used in the implementation of one or more methods of playing drawing games, is illustrated in FIG. 1. As shown, board game 100 may include a game board 102 comprised of a path 104 of multiple path positions 106 including a start position 108 and a finish position 110. Board game 100 may further include two or more game pieces 112, a timer 114, at least one die 116, a deck 118 of word cards 120, at least one paper tablet 122, and at least one writing utensil 124.

The path positions may correspond to various categories of words or phrases indicated on word cards 120. For example, categories may include, but are not limited to, action, people/places/animals, objects, difficult, etc. When a team's playing piece lands on a particular path position, the team may thus be required to perform a method of drawing game corresponding to the respective category indicated on the path position.

Additionally or alternatively, the path positions may correspond to one or more of the various methods of playing drawing games discussed in detail below. For example, a first team may initially begin on the start position which may correspond to a first method of the present disclosure. If the first team successfully wins the round of play (as will be more fully understood from the description of the various methods described below), a member of the first team may be permitted to roll the die 116 and move his or her team's game piece 112 the corresponding number of positions along the path to a new path position. The new path position may correspond to a different method than the start position corresponds to, or the new position may correspond to the same method.

In some embodiments of the board game, the first team may be permitted to immediately play another round of play corresponding to the appropriate method indicated by the space the first team's game piece landed on. In other embodiments of the board game, the team may have to relinquish control to a second team, and may be permitted to play the next round only upon its next turn. The board game may be won upon one of the teams making it completely around the path to the finish square and successfully completing a final round of game play.

Other variations of board games implementing the various methods of playing drawing games are also within the scope of the present disclosure. Other games not including a game board may implement the various methods of playing drawing games. For example, a game incorporating a point-based scoring system rather than movement of game pieces around a game board path, may implement the various methods of playing drawing games according to the present disclosure.

Figure 2:
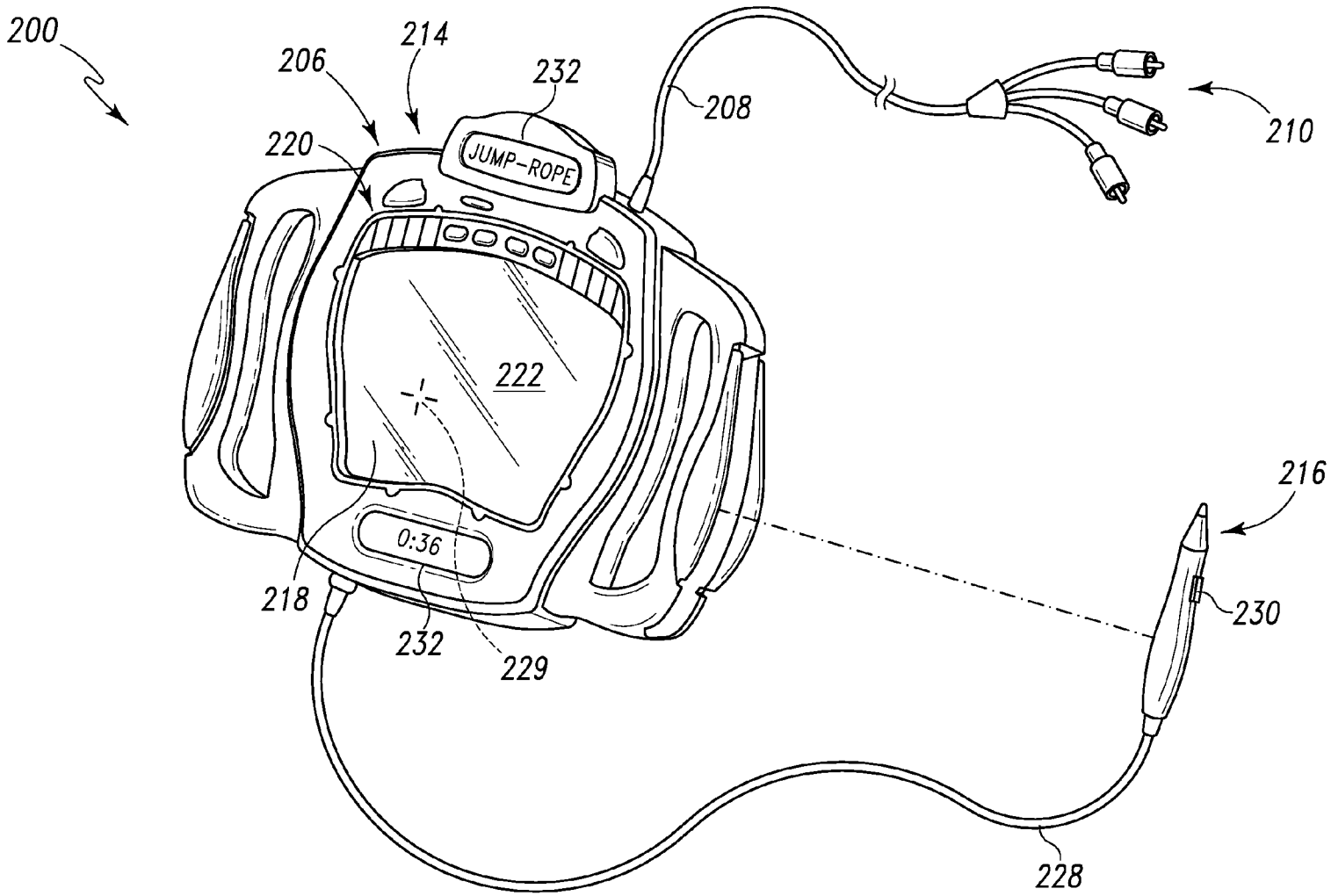
FIG. 2 is an isometric view of an electronic game system for interactively providing methods of playing drawing games.

Turning to FIG. 2, a non-exclusive illustrative example of an electronic game system adapted to play the methods of the present disclosure is depicted and generally indicated at 200. As shown, game system 200 may be independent of a personal computer and may additionally or alternatively be referred to as an interactive electronic drawing game system or as a plug and play drawing game or game system.

System 200 may be configured for use with a video display 202 (shown in FIG. 3), for example in the form of a television 204; however, display 202 may be in the form of a monitor, a digital projector with accompanying screen, or any other appropriate display device. System 200 may include a drawing input device 206 configured to receive user input including input drawings. System 200 may be adapted to output video data to the video display including output drawings corresponding to the input drawings.

System 200 may be directly connected to the video display. For example, the system may include cabling 208 that may be connected to video and/or audio inputs 210 of the video display. The cabling may be in the form of RCA cabling, coaxial cabling, S-video cabling, or any other suitable video or audio/video cabling. The cabling may be hard-wired to the system, or in other embodiments, the system may include connectors for selectively coupling separate cabling to system 200. In embodiments where separate cabling is incorporated, the system may include connectors for one type of cabling, or may include connectors for multiple types of cabling, thus enabling the device to be connected to a variety of video displays depending on the corresponding connection on the video display.

System 200 may also be operably connected to the video display through one or more peripheral devices. For example, the system may be connected to the video or audio/video inputs of a peripheral device such as a VCR, DVD player, receiver, or any other appropriate peripheral device with video or audio/video inputs. The peripheral device may in turn be connected to the video display. The system may additionally or alternatively include a wireless transmitter that wirelessly transmits the output data to a wireless receiver that is directly or peripherally attached to the video display.

Figure 3:
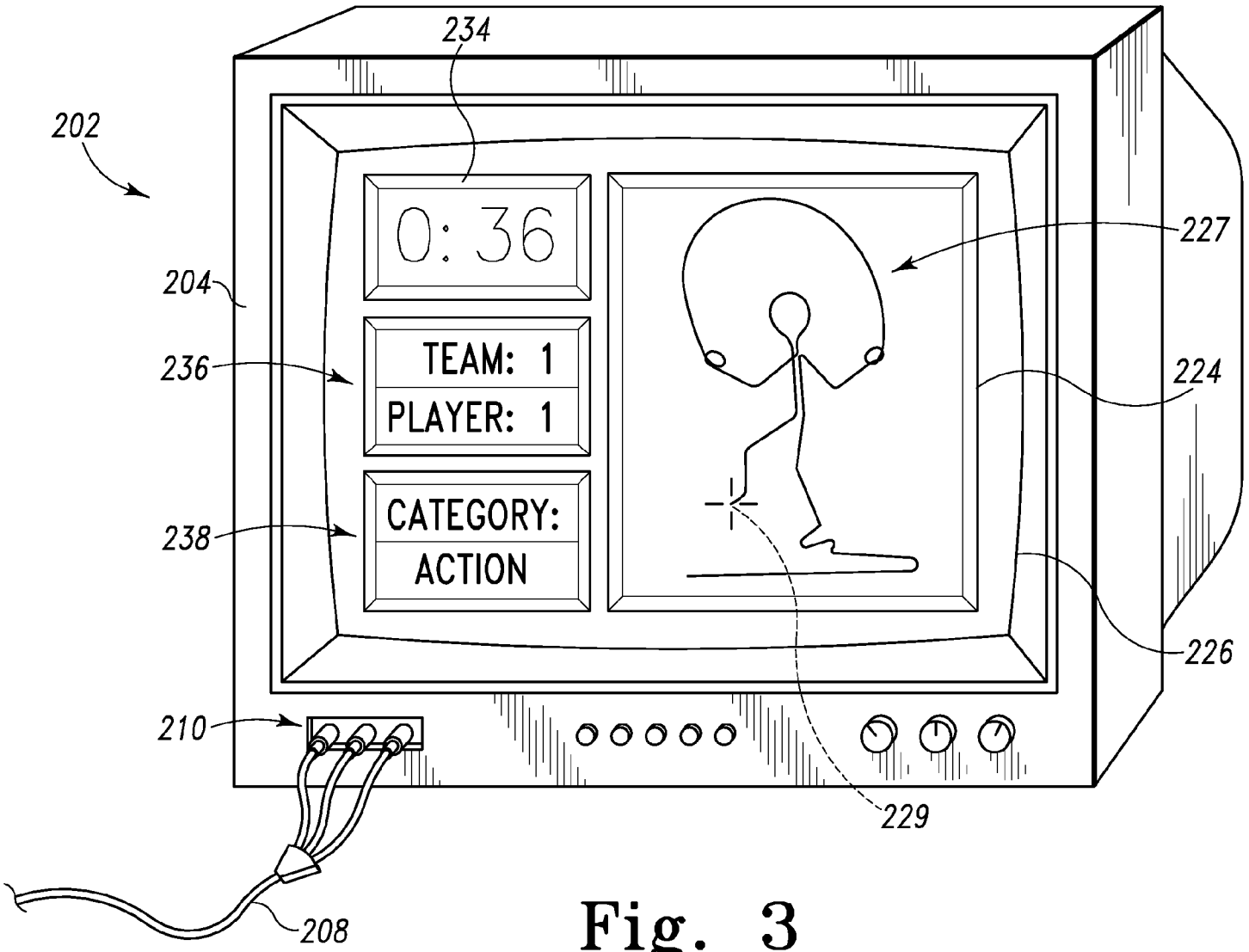
FIG. 3 is an isometric view of a video display depicting output video data of an electronic game system for interactively providing methods of playing drawing games.

In some embodiments, the drawing input device may be in the form of a tablet 214 and a stylus 216 as depicted in FIG. 2. The tablet may include a touch pad 218, various user controls 220, and appropriate other electronic hardware (for example a processor, memory, etc.). A surface area 222 of the touch pad may generally correspond to an area 224 of a video display screen 226 (as shown in FIG. 3) and may be sensitive to stimuli provided by the stylus or other external implement such as a finger (hereinafter "stylus"). Specifically, the stylus may be used to draw on the touch pad, thereby providing an external stimulus that interacts with the tablet to create a user input signal. The user input signal may then be processed into a video signal by the tablet's processor, which is transmitted to the video display either directly, or through a peripheral device attached to the video display, as described above. The video display may receive the video signal and display it as a drawing on the screen, for example as shown at 227 in FIG. 3. A player may thereby generate lines on the video display at the location corresponding to the stimuli provided by the stylus on the touch pad.

In some embodiments, the touch pad may be configured to detect pressure provided by the stylus, or to detect a physical property of the stylus, such as magnetism, electrical potential or any other detectable physical property. The stylus may be detectable by the touch pad without the stylus actually making contact with the touch pad. The tablet may measure electrical potential across the X and Y axes of the touch pad as an analog user input signal. Applying the stylus to any single point on the pad may create a resistive divider that effects a change in the measured potential across both the X and Y axes. An analog user input signal may be generated, based on the measured potentials across the X and Y axes, corresponding to the location that the stylus contacts the touch pad. The processor may convert the analog user input signal into an analog or digital video signal representing the location the stylus contacts the touch pad. Other methods and systems for converting user input from the tablet into video data for display on the video display, as are known in the art, may also be incorporated into the electronic game system of the present disclosure.

The video signal may include a movable cursor 229 (as shown in FIG. 3), displayed on the video display at a location corresponding to the location the touch pad senses the stylus (as shown in FIG. 2). The tablet and stylus may function such that the user may move the cursor on the video display without drawing a line. When a user wishes to draw a line, the user may activate a drawing function and draw a line at the location of the cursor. The drawing function may be activated by user input such as double-clicking (or double-tapping) the stylus at the location the user wishes to begin a line, engaging a button on the stylus or the tablet, or any other appropriate form of user input.

In some embodiments, stylus 216 may be electrically connected to the tablet, for example via a wire 228. The stylus may include a user actuatable button 230 on the stylus. When the button is not actuated, applying the stylus to a location on the touch pad may cause a movable cursor to be displayed in a corresponding location on the display screen, without drawing a line. When a user actuates button 230, the line drawing function of the stylus may be activated, and a line may be drawn on the screen at a position corresponding to the location of the cursor.

Additionally or alternatively, the stylus may include a retractable tip that is biased out of the end of the stylus by a spring or other biasing mechanism. When a user lightly applies the tip of the stylus to the touch pad, the cursor may be displayed on the screen of the video display at a location corresponding to the location the stylus contacts the touch pad. If a user applies sufficient pressure to the touch pad with the stylus, the tip may retract within the stylus until an internal electrical contact is made. This electrical contact may generate a signal to the tablet's processor to begin drawing a line at the location of the cursor.

System 200 may also include memory for storing game parameters and other information relating to game play. The memory may include ROM, RAM, flash, or any other form of memory capable of storing game parameters and other information relating to game play including, but not limited to, player instructions, categories, words, game boards, player and team names, scores, sounds, and software or other computer instructions for operating system 200. The system may also include removable memory, such as, flash memory cards, smart cards, game cartridges, floppy discs, CDs, DVDs, or any other removable memory for storing game parameters and other information. For example, removable memory may be used to update software and game features previously stored in the memory or to provide additional word lists and/or new game methods, etc.

As discussed and shown in FIG. 2, the tablet may also include user controls 220. The user controls may control functions including, but not limited to, line attributes, such as type of drawing tool (pencil, pen, paintbrush, airbrush, eraser, etc.), color of the line generated by the stylus, weight or thickness of the line generated by the stylus, etc. The user controls may also control functions including administrative functions such as <select> or <enter> used in game configuration (for example in the entering of player names, selecting of methods to play, etc.) and <start> or <pause> used to activate the game timer, etc.

In some embodiments the user controls may be actuated by the stylus. In these embodiments, the user controls may be represented on the touch pad itself with appropriate markings as shown in FIG. 2, such that when the stylus is applied to a user control, the corresponding function is activated. Additionally or alternatively, one or more user controls may be associated with other stylus-sensitive areas on the tablet.

In some embodiments the user controls may be actuated by hand. For example, buttons, keys, switches, or any other finger or hand actuated user controls may be incorporated into system 200 to perform the functions.

In some embodiments, the stylus itself may incorporate buttons that control one or more of the various functions described above to enable a player, for example, to switch between drawing tools and line colors, make administrative selections, etc., without moving the stylus from a desired location on the touch pad to a remote location on the touch pad.

As shown in FIG. 2, system 200 may also include one or more LCDs or other appropriate display devices 232 for displaying game related information to a user. The LCDs or other display devices may display to a user the word in play (i.e., the word provided to the appropriate player according to the methods of the present disclosure) or other communications that a user may need to receive while the other players may not need or should not receive (for example as shown in FIG. 2 displaying an illustrative example of a word in play: "jump-rope").

The LCD or other display device may also display the score, team names, the current image displayed on the video display, or any other information related to game play (for example the time remaining on the timer as shown in FIG. 2).

Game systems according to the present disclosure may include software, programming, coding, or other computer instructions incorporating a variety of drawing games (including the methods of playing drawing games of the present disclosure) with the game hardware discussed above. For example, board game 100, described above and depicted in FIG. 1, may be adapted for use with the game systems of the present disclosure. Also, one or more of the PICTIONARY® board game, the PICTIONARY® Challenge Edition™ board game, and the PICTIONARY JUNIOR® board game may be adapted for play on the game systems.

In some embodiments, the game system may include one or more of a physical game board, game pieces, a game die, game cards with subject matter, a timer, a score display, or any other game apparatus that facilitates a parlor style drawing game where drawings are made on the drawing input device and displayed on the video display, but where part of the game play is played on physical components, for example a game board.

In other embodiments, the video display may be used to display virtual representations of at least one of these or other game components. For example, as depicted in the non-exclusive example in FIG. 3, the video display may be used to display a timer 234, player and/or team names 236, and categories of play 238. The video display may also be used, however, to display virtual representations of a game board, game pieces, a game scoring system, various menu screens and game options, and any other game parameters, such that some or all of the game play takes place on the video display rather than on a traditional game board.

In embodiments incorporating the PICTIONARY® family of board games, the All Play function may randomly appear on the display screen rather than being assigned only to particular word cards as All Play is implemented in the board game versions.

Various screens may be used to show game set-up (including player name input, team name input, game choice, etc.), the game board, the score, the drawing area, the word in play, etc. If the video display or other device with video or audio/video inputs which in turn is connected to a video display has speakers or external speakers connected to it, sounds corresponding to various functions of the game may be used to signal the players of various aspects of the game. For example, a buzzer sound may be used to indicate the expiration of time for a particular round.

Also, music may accompany various portions of gameplay. The game may be paused. Different levels of difficulty may be set. Teams and team members may input their names which may be displayed on the display screen. The game may randomly determine which player for a particular round is required to draw (for example to prevent players from only participating in rounds of their choice).

Team names may be displayed in relation to the scores or in conjunction with the game-pieces on the game-board. The word in play may either be provided on physical cards, may be displayed on the LCD or other display device 232 on the game system, or may be displayed on the display screen for a period of time. One embodiment of the latter method of providing the word in play on the display screen, provides for a warning for the players not responsible for sketching clues (during the current round of game play) to either look-away or close their eyes for a period of time to enable the player who is responsible for sketching clues to read the word in play.

Player and team name input may be facilitated by the display of a digital version of a keyboard on the video display and implemented by use of the drawing input device. Also, the drawing input device may include a keyboard or be able to have a keyboard attached. Additionally or alternatively, player and team name input may be facilitated by the use of the drawing input device and then displayed on the video display in hand-written or drawn form.

As discussed, multiple versions of interactive drawing games may be incorporated into the game systems of the present disclosure. With a game corresponding to PICTIONARY® Challenge Edition™, various challenges corresponding to the faces of the challenge die corresponding to the board game version in addition to other types of challenges (drawing with your eyes shut, drawing with your opposite dominant hand, drawing with one continuous line, drawing mirror-imaged, and drawing upside down) may be randomly assigned to a round or may be pre-assigned to particular words or phrases that lend themselves to being particularly suited for a particular challenge.

In addition to the above described embodiments, any number of drawing input devices or combination of drawing input devices may be incorporated into game systems specifically adapted to play the methods of the present disclosure. For example, a joy stick input device, a game-pad input device such as commonly used with home gaming systems, a trackball input device, a mouse, a key board, or any other drawing input device may be used in cooperation with the various functions discussed above.

Also, all of the cabling, including the cabling from the drawing input device to the video display and the cabling from any player input device to any control unit may be substituted with wireless signaling. For example, BLUETOOTH® technology is well suited for short distance wireless communications between gaming components.

The game systems may be adapted to store drawings in memory from any of the various methods and variations of the drawing games incorporated into the game. The drawings may be able to be viewed during non-game play. For example, users may be able to store their favorite drawings to show friends and family. In addition, the game systems may be configured for attachment to an external printer for printing the drawings, or to a computer for transferring the drawings as digital files.

The above described game apparatuses have been disclosed in a preferred form; however, the specific embodiments thereof as disclosed and illustrated herein are not to be considered in a limiting sense as numerous variations are possible. The subject matter of the inventions includes all novel and non-obvious combinations and subcombinations of the various elements, features, functions and/or properties disclosed herein. Similarly, where the disclosure recites "a" or "a first" element or the equivalent thereof, such disclosure should be understood to include incorporation of one or more such elements or limitations, neither requiring nor excluding two or more such elements.

Methods of playing drawing games according to the present disclosure may be performed by any suitable number of players. For example, the methods may be played by two or more teams composed of one or more players.

The methods may be played individually as games in themselves, or they may be incorporated into a greater multi-faceted game, for example into a board game, a computer game, an electronic game system, or any other suitable game system or mechanism. For example the methods may be incorporated into board game 100 or electronic game system 200 described above.

Such board game, computer game, game system, or other game mechanism may incorporate a single method of the present disclosure, or it may incorporate more than one of the methods of the present disclosure. For example, a game may incorporate a random selection of one or more of the methods, or may incorporate one or more of the methods based on user input. For example, players may indicate before starting the game which method or methods the players will be employing in the playing of the game.

Players may be required to manually roll a die, spin a spinner, draw a card, or perform any other suitable selection mechanism for determining which method or methods are employed in their playing of the game. In the case of a computer game or a game system adapted to play the methods of the present disclosure, players may interact with the system for determining which method or methods are to be played (e.g., by selection of the method of methods from a menu or menus presented on a video display). Additionally or alternatively, a computer game or a game system may provide for a random selection (or at least a simulated random or arbitrary selection) of a method or methods to be played.

Turning to FIGS. 4-10, several flow charts are provided representing various methods of playing drawings games. The flow chart blocks generally indicate steps of the various methods and are generally arranged in chronological order beginning at the top of the diagrams with the order indicated by the connecting arrows; however, two or more blocks indicated as generally horizontal from one another do not necessarily indicate initiation of the respective steps at the exact same time, as will be further understood from the discussion below of the various disclosed methods.

Figure 4:
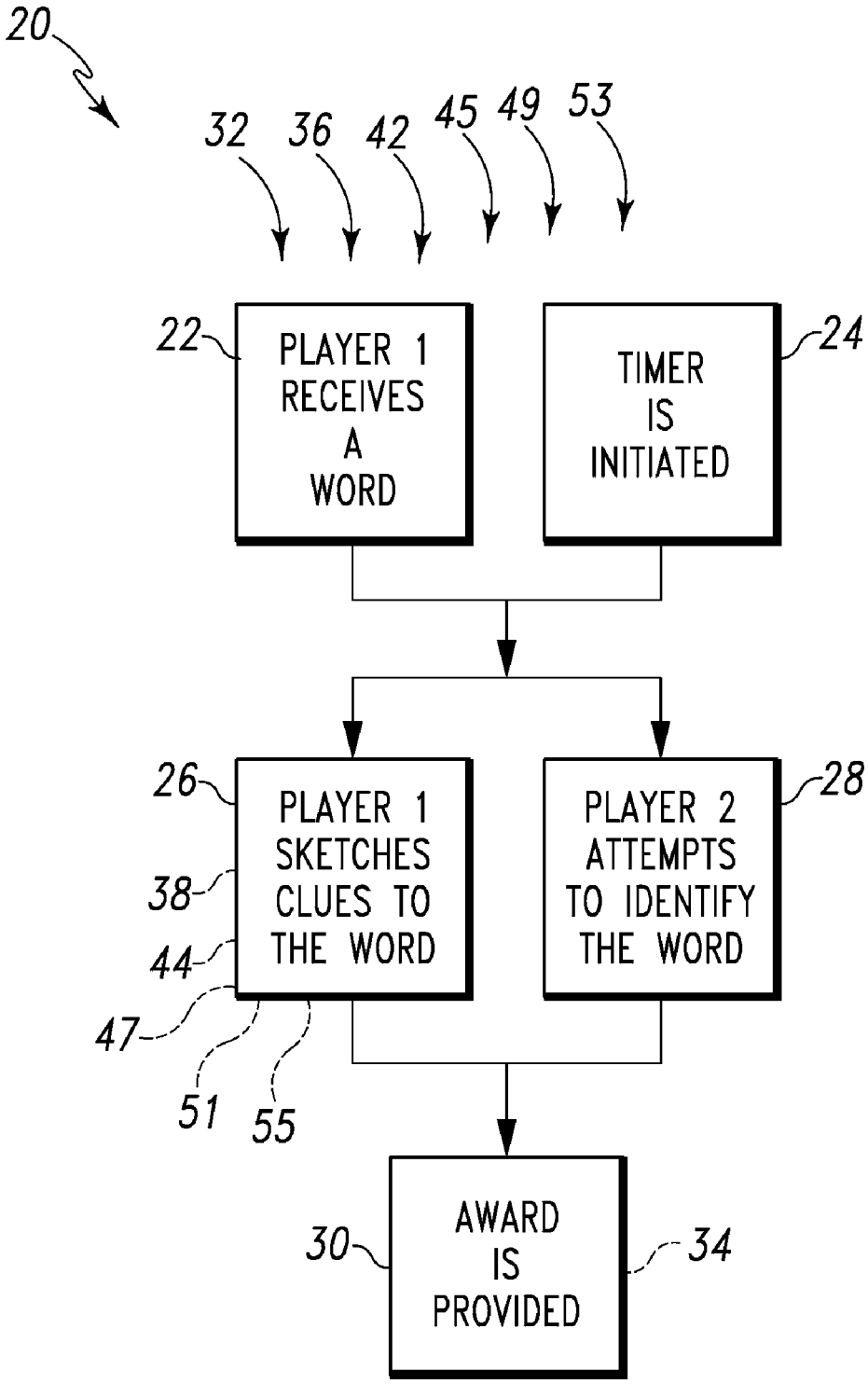
FIG. 4 is a flow chart illustrating methods of playing drawing games.

FIG. 4 illustrates a generic method of playing drawings games 20 including the steps of: providing a word to a first player, as indicated at 22; initiating a timer, as indicated at 24; sketching, by the first player, clues to the word to create a drawing, as indicated at 26; attempting, by a second player observing the drawing, to identify the word, as indicated at 28; and providing an award based at least in part on the whether the second player correctly identifies the word before the timer runs to a predetermined time, as indicated at 30. Step 22 and step 24 may be initiated at the same time, step 22 may be initiated prior to step 24, or step 24 may be initiated prior to step 22. Steps 22 and 24 are, however, required to be initiated prior to steps 26 and 28 as generally indicated by the arrows.

The award of step 30 may be any suitable award based on the particular embodiment of game incorporating the various methods of the present disclosure. For example, the award may be advancement of a game piece on a game board (or a virtual game piece on a virtual game board). Additionally or alternatively, the award may be a point or points awarded to the team of the player who sketched the drawing and/or the team of the player who correctly identified the word. Any suitable award based at least in part on whether the second player identifies the word before the timer runs to a predetermined time is considered within the scope of the present disclosure.

Methods according to the present disclosure may incorporate novel steps beyond those explicitly illustrated in FIG. 4. For example, a first method of playing drawing games 32 may incorporate steps 22, 24, 26, 28, and 30 such that step 30 is further defined as providing an award based at least in part on the number of continuous lines used by the first player in the drawing of the clues and on whether the second player correctly identifies the word before the timer runs to a predetermined time, as indicated at 34. In some versions of method 32, the award may be greater when the first player uses fewer continuous lines (i.e., a drawing with fewer strokes of the writing utensil, stylus, or other drawing input device, will provide a greater award than a drawing with greater strokes of the writing utensil, stylus, or other drawing input device).

Determination of the number of continuous lines used by the first player in method 32 may be determined in any suitable manner. For example, the players may simply count the number of individual strokes used (or the players may count the individual end points of each line and divide by two). In the instance of method 32 being incorporated into a computer game, a game system, or other game mechanism (e.g., the electronic game system described above), appropriate software and hardware may provide the necessary mechanisms for determining the number of continuous lines.

The award of step 34 may be any suitable award based on the particular embodiment of game incorporating method 32. For example, a non-exclusive example of an award appropriate for method 32 includes advancement of a game piece on a game board as determined by the number of continuous lines used. For example, a non-exclusive example of a game board award scheme may provide for advancement of the game piece one space for drawings incorporating greater than ten continuous lines, three spaces for drawings incorporating five to nine continuous lines, five spaces for drawings incorporating two to five continuous lines, and seven spaces for drawings incorporating only a single continuous line; however, any appropriate scheme may be used. The game board and game pieces may be physical components of a game or they may be virtual representations of components for example in the instance of method 32 being incorporated into a computer game, a game system, or other game mechanism as discussed.

Additionally or alternatively, the award may be a point or points awarded to the team of the player who sketched the drawing and/or the team of the player who correctly identified the word. For example, a non-exclusive example of a point-based scheme may award one point for drawings incorporating greater than ten continuous lines, two points for drawings incorporating five to nine continuous lines, and three points for drawings incorporating less than five continuous lines; however, any point-based system may be used. The first player and the second player may be members of the same team, or they may be members of different teams. The award may additionally or alternatively be negative points penalized against the team whose player or players did not correctly identify the word.

The predetermined time of step 30 may be any suitable time appropriate for the particular game being played. For example, the predetermined time may be one minute, two minutes, three minutes, or more, or any fractional value of minutes as may be appropriate. The time may be predetermined by the game itself or by the players of the game. For example, a board game incorporating step 30 may include a sand timer. A computer game, game system, or other game mechanism incorporating step 30 may include a digital timer. The predetermined time may be set as a constant, such that every time a method of playing a drawing game incorporating step 30 is played, the same time is used. Additionally or alternatively, method 32, as well as other methods incorporating step 30 (as discussed below), may provide for variable predetermined times. That is, a specific game incorporating step 30 may provide different predetermined times for different instances of playing the various methods of the present disclosure. Additionally or alternatively, players of the various methods may determine the predetermined time themselves prior to initiating a method of the present disclosure.

Referring back to FIGS. 2 and 3, an instance of method 32 is shown implemented on system 200. As shown in FIG. 2, one of display devices 232 may display the word provided to the first player, or a word in play (e.g., "jump-rope"), while the other display device 232 may display the time remaining on the timer (e.g., thirty six seconds). As shown in FIG. 3, a drawing 227 is shown in area 224 of video display screen 226, represented by a continuous line (as the first player of method 32 may sketch the word in play—with as few continuous lines as possible. In the example shown here, only a single continuous line has been used to sketch "jump-rope"). Also, as discussed above, FIG. 3 shows digital timer 234 corresponding to time remaining on the timer, player and team information 236, and other game parameters 238 in the form of a category which may be incorporated into method 32.

A second method of playing drawing games 36, also generally indicated in FIG. 4 and incorporating steps 22, 24, 26, 28, and 30, may include a step 38 further defining step 26 as: sketching, by the first player, clues to the word to create a drawing, the drawing limited to a combination of a predetermined set of shapes.

The limitation of step 38 may be any appropriate predetermined set of shapes. For example, the first player may be limited to only using circles, limited to only using squares, limited to only using straight lines, limited to only using circles and squares, etc. The set of shapes may further be limited to a specific size or may be all limited to the same size. For example, the first player may be limited to only using equilateral triangles with one inch (or approximately one inch) sides. Again, the predetermined set of shapes may include any suitable individual shapes of arbitrary or specific size. The set of shapes may be determined by the players prior to the playing of an individual method 38, prior to the playing of a game incorporating method 38, etc. The set may be determined by player voting, the instructions of a game, player input such as the rolling of a die or dice or the spinning of a spinner, etc.

In the case of method 36 being incorporated into a computer game, a game system, or other game apparatus or mechanism, the set of shapes may be determined by the software incorporated into such systems. For example, such systems may incorporate a greater set of predetermined sets of shapes, such that different predetermined sets of shapes are used as limitations for different instances of playing method 36. In other words, method 36 may be played with the limitation of squares during one instance, and may be played with the limitation of circles during another instance. Additionally, such systems may incorporate randomness (or at least simulated randomness) into the determination of the limitation of step 38.

A third method of playing drawing games 42, also generally indicated in FIG. 4 and incorporating steps 22, 24, 26, 28, and 30, may include a step 44 further defining step 26 as: sketching, by the first player, clues to the word to create a drawing, the drawing being limited to clues not depicting the physical manifestation of the word. An illustrative non-exclusive example of a word may be cat. As such, the first player is not permitted to sketch a cat, and must instead sketch other clues not depicting a cat. For example, the first player may sketch a bowl of milk and ball of yarn, neither of which depict the physical manifestation of a cat.

A fourth method of playing drawing games 45, also generally indicated in FIG. 4 and incorporating steps 22, 24, 26, 28, and 30, may include a step 47 further defining step 26 as: while continuously producing verbal sound, sketching, by the first player, clues to the word to create a drawing. In some versions of method 45, the first player may be required to hum. For example, in some versions the first player may be required to hum anything, while in other versions the first player may be required to hum a specific tune. For example, in an embodiment of a board game incorporating method 45, such as board game 100 depicted in FIG. 1, a word card 120, in addition to providing the word-in-play to the first player, may also provide the specific tune that the first player is required to hum.

Other versions of method 45 may include requirements other than humming. For example, some versions may require continuous singing, continuous talking, recitation of a specific script or other grouping of words such as famous speeches, poems, etc. Requiring any continuous verbal sound production is within the scope of the present disclosure and may be incorporated into versions of method 45.

A fifth method of playing drawing games 49, also generally indicated in FIG. 4 and incorporating steps 22, 24, 26, 28, and 30, may include a step 51 further defining step 26 as: sketching, by the first player while continuously holding his/her feet off the floor, clues to the word to create a drawing. In carrying out method 49, award step 30 may be further define as appropriate to penalize the first player, or the first player's team, if the first player is unable to continuously hold his/her feet off the floor. For example, advancement of the first player's playing piece may be prohibited, no points may be awarded, or a reduced advancement of the playing or piece or the awarding of points may be required.

A sixth method of playing drawing games 53, also generally indicated in FIG. 4 and incorporating steps 22, 24, 26, 28, and 30, may include a step 55 further defining step 26 as: sketching upside-down, by the first player, clues to the word to create a drawing. In other words, the first player must sketch the clues generally from the perspective of the second player when the second player is positioned generally in front of, or across from, the first player. For example, if the word in play is house, and the first player sketches a house, then from the perspective of the first player the roof of the house must be generally toward the bottom of the page and the floor of the house must generally be toward the top of the page.

In embodiments of electronic drawing games, such as electronic drawing game 200 described above, incorporating method 53, the electronic drawing game may (but is not required to) be configured to generally reverse, or mirror image along a horizontal axis, the output image from the input image. In other words, if the first player draws an upside down house with the drawing input device, the electronic drawing game may output data corresponding to a right-side up house for display on the display screen.

Figure 5:
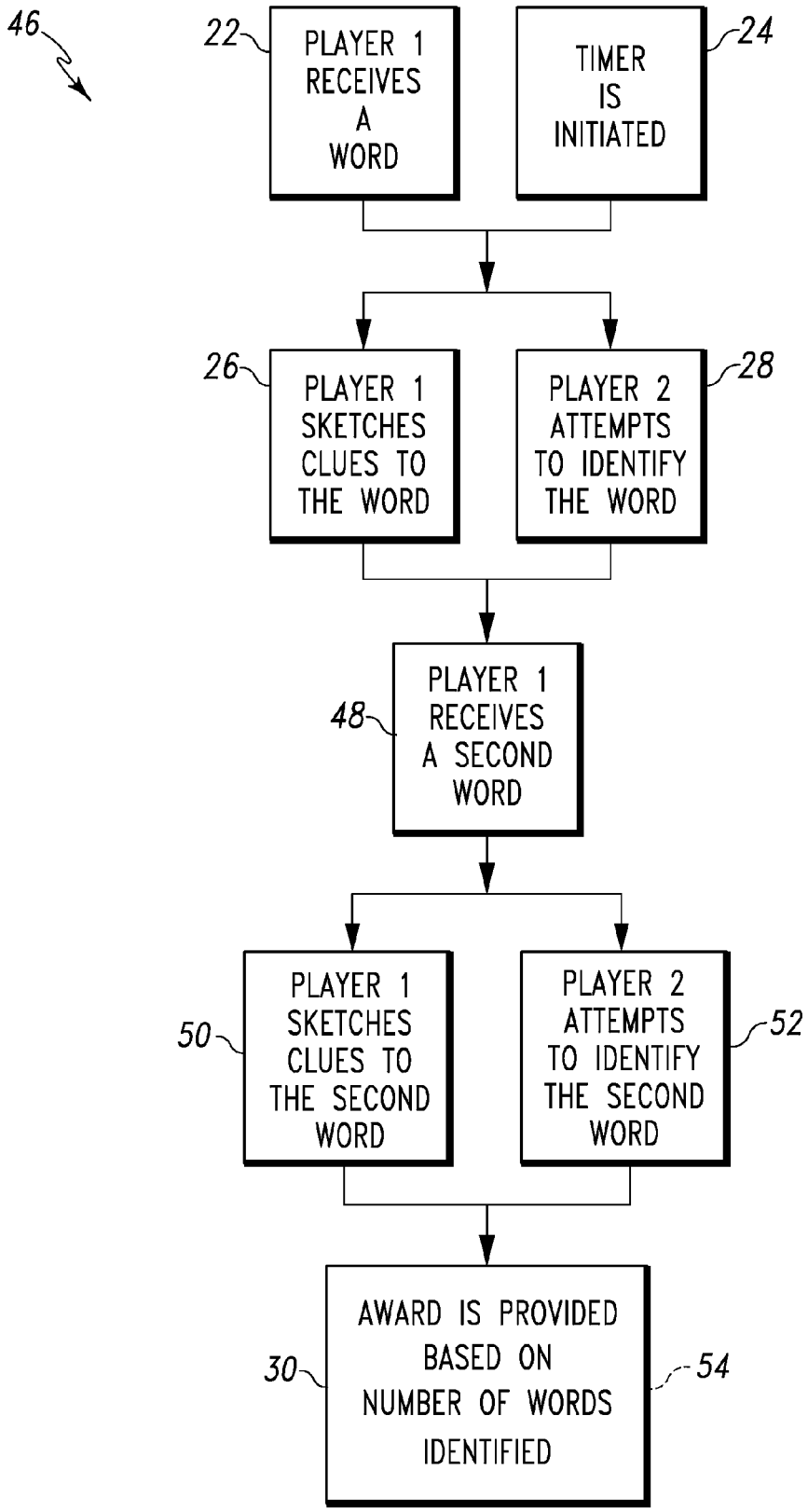
FIG. 5 is a flow chart illustrating at least another method of playing a drawing game.

A seventh method of playing drawing games 46 is generally represented by the flow chart in FIG. 5. Method 46 incorporates steps 22, 24, 26, 28, and 30 as discussed above; however, following the completion of steps 26 and 28, method 46 further includes a step 48 at which point the first player receives a second word. Following step 48, the first player sketches clues to the second word, as indicated at 50, and the second player attempts to identify the second word, as indicated at 52. Upon completion of steps 50 and 52, method 46 may further include (but is not required to include) additional steps at which point first player receives a third word, a fourth word, etc. Any number of words may be provided to the first player before the timer runs to the predetermined time.

A game incorporating method 46 may include any number of possible words to be provided to the first player. For example, method 46 may include only the possibility of providing two words to the first player, or alternatively method 46 may include the possibility of providing several words to the first player before the timer runs to the predetermined time. For example, in an example of method 46 incorporated into a board game, the words may be provided on a card drawn from a deck of cards. The first player may continually draw cards from the deck, until the second player no longer is able to identify the respective word and the timer runs to the predetermined time. In an example of method 46 incorporated into a computer game, a game system, or other game mechanism, the words may be stored in a database and provided to the first player upon the first player (or other user) inputting a signal or other indication (e.g., pressing a button on a component of the computer, game system, or other game mechanism).

In some examples of method 46, step 48 may be initiated only upon the second player correctly identifying the first word. In other examples of method 46, the second player (or the first player) may be permitted to pass on the first word and proceed to step 48 before the second player correctly identifies the first word. In examples of method 46 incorporating further steps of providing a third word, a fourth word, etc. (as discussed above), such steps may likewise depend on either the second player correctly identifying the previously provided word or the first player or the second player passing on the previous word.

Step 30 of method 46 may be further defined as a step 54 such that the award is based at least in part on the number of words correctly identified by the second player before the timer runs to the predetermined time. The award of step 54 may be any suitable award based on the particular embodiment of game incorporating method 46. For example, in an example of method 46 being incorporated into a board game, the award may be advancement of a game piece on a game board. The game may provide that the game piece is advanced further along the game board for the more words the second player correctly identified. For example, a non-exclusive award scheme for method 46 incorporated into a board game may provide that the game piece is advanced one space for every word correctly identified by the second player before the timer ran to the predetermined time. Additionally, advancement of the game piece may further be (but is not required to be) based in part on the rolling of a die or dice, or the spinning of a spinner, etc.

Additionally or alternatively, the award of step 54 may be a point or points based on the number of words correctly identified by the second player before the timer ran to the predetermined time. Again, the award of step 54 may be any suitable award based on the particular embodiment of game incorporating method 46.

Figure 6:
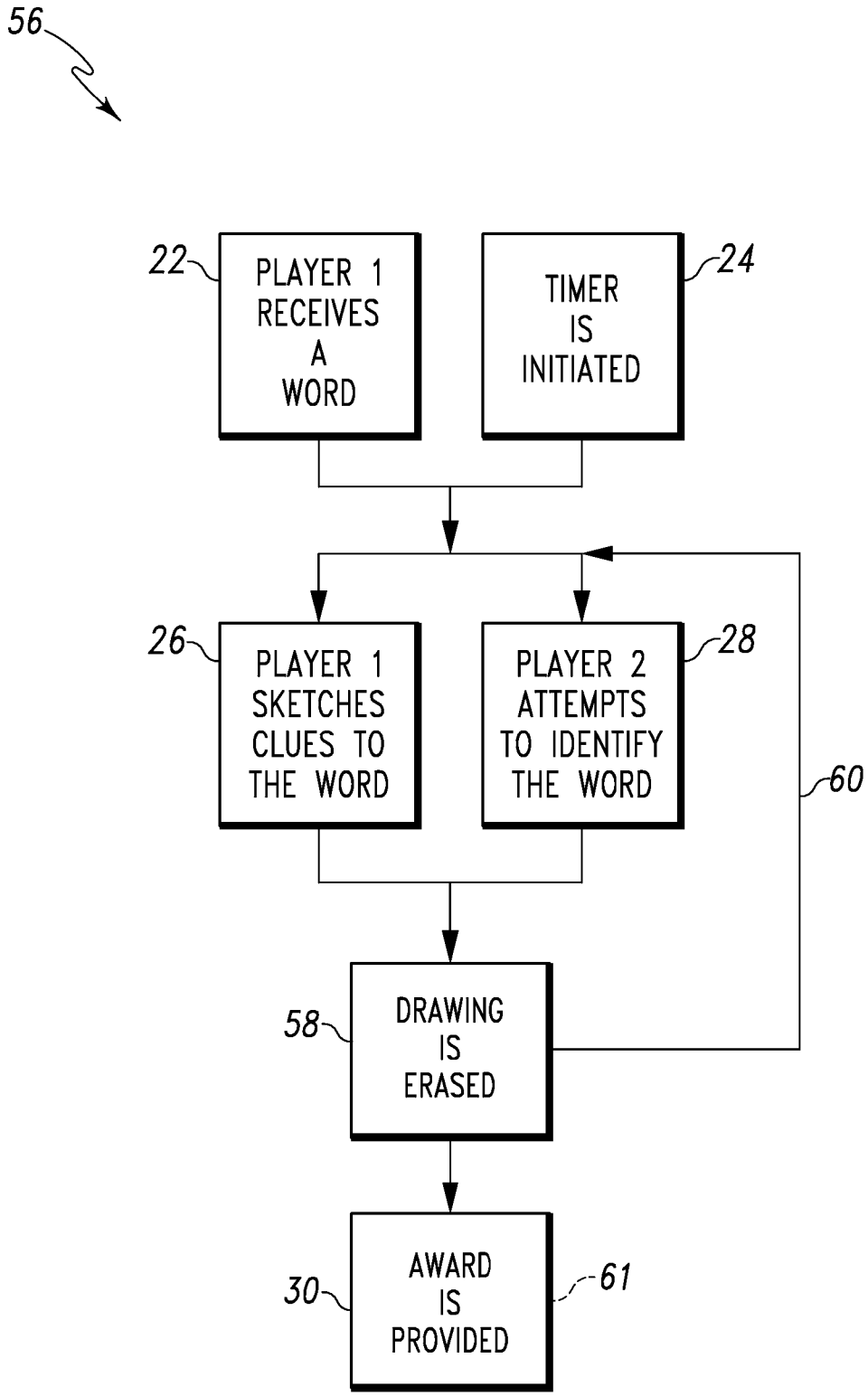
FIG. 6 is a flow chart illustrating at least another method of playing a drawing game.

An eighth method of playing drawing games 56 is generally represented by the flow chart in FIG. 6. Method 56 incorporates steps 22, 24, 26, 28, and 30 as discussed above; however, following the completion of steps 26 and 28, method 56 further includes a step 58 at which point the drawing sketched by the first player during step 26 is erased after a first predetermined time in sequence to how the drawing was sketched. In other words, after the first predetermined time lapses, the lines sketched by the first player (either with appropriate writing material and utensil or appropriate drawing input device, depending on the embodiment of game incorporating method 56) are erased beginning with a first point where the first player initially began the drawing. The lines are then sequentially erased in the order in which they were sketched by the first player, as the first player continues to sketch the drawing, as generally indicated in FIG. 6 at 60. In other words, steps 26 and 28 are initiated prior to step 58, but steps 26 and 28 may continue to be performed once step 58 is initiated. In some instances of playing method 56 however, the second player may correctly identify the word before step 58 is initiated, at which point step 58 is generally irrelevant, and step 30 may subsequently be performed.

Method 56 is particularly well suited for incorporation into a computer game, game system, or other game mechanism including software configured to perform step 58 (e.g., electronic game system 200 discussed above and shown in FIG. 2). Step 58 may be performed in a variety of ways. For example, the drawing may be erased point by point, in approximately the same sequence in which it was sketched. In other words, after the first predetermined time, the drawing simply begins to disappear, retracing the lines as they were sketched. The points may be erased at a uniform rate, at an increased rate as time passes, at a decreased rate as time passes, at an arbitrarily changing rate as time passes, or at a rate according to any mathematical formula as time passes. As such it may be in the interest of the first player to sketch the clues as quickly as possible, permitting the second player to observe as much of the drawing as possible before it begins to disappear.

In other versions of method 56, the drawing may be erased line by line, in approximately the same sequence in which it was sketched, such that a line is defined by a single continuous application of a user input specifically configured to create a drawing. For example, a single continuous application of a stylus against a tablet, or a single application of a mouse button or a joy stick button, for example in computer games, game systems, or other game mechanisms incorporating method 56. In such applications of method 56, a first line may completely disappear after the first predetermined time, a second line may disappear after a multiple of the first predetermined time, etc. Additionally or alternatively, subsequent lines may disappear at an increased rate as time passes, at a decreased rate as time passes, at an arbitrarily changing rate as time passes, or at a rate according to any mathematical formula as time passes. Again, it may be in the interest of the first player to sketch the clues as quickly as possible, permitting the second player to observe as much of the drawing as possible before it begins to disappear.

Step 58 of method 56 may also be incorporated into any of the other methods of the present disclosure. For example, step 58 may be incorporated into second method 36, such that each shape (from the set of predetermined shapes) sketched by the first player may be erased either point by point, or line by line, or alternatively as an entire shape in itself, in sequence to how it was sketched.

Step 30 of method 56 may further be defined as a step 61 such that the award is based at least in part on whether the second player correctly identifies the word before the timer runs to a second predetermined time. As such the award of step 61 may be any suitable award based on the particular embodiment of game incorporating method 56.

Figure 7:
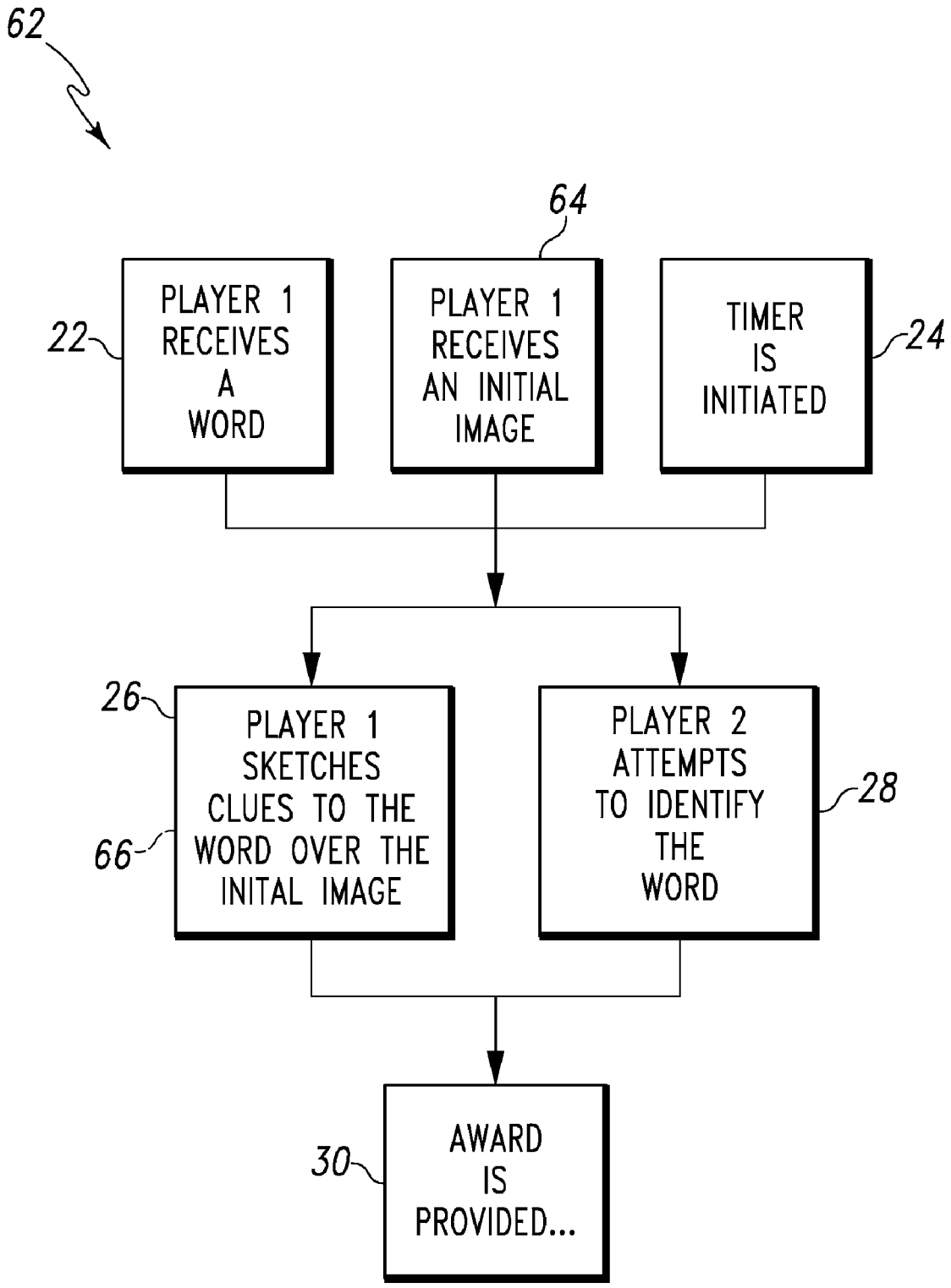
FIG. 7 is a flow chart illustrating at least another method of playing a drawing game.

A ninth method of playing drawing games 62 is generally represented by the flow chart in FIG. 7. Method 62 incorporates steps 22, 24, 26, 28, and 30 as discussed above; however, prior to the initiation of steps 26 and 28, a step 64 is performed such that the first player receives an initial image. The initial image may be any appropriate image. The initial image may be related to the word or it may be unrelated to the word. The initial image may increase or it may decrease the difficulty for the second player in step 28 to correctly identify the word. Step 64 may be implemented prior to steps 22 and 24, subsequent to steps 22 and 24, prior to step 22 but subsequent to step 24, subsequent to step 22 but prior to step 24, or simultaneously with steps 22 and 24. Step 26 of method 62 may therefore be further defined as a step 66: sketching, by the first player, clues to the word to create a drawing incorporating the initial image.

The initial image may be provided in any suitable manner as appropriate for a particular embodiment incorporating method 62. For example, in a non-exclusive example of a board game incorporating paper tablets for use by the first player to sketch the clues, the paper tablets may have the initial images printed on them prior to the initiation of method 62 (i.e., the board game may come equipped with pre-printed tablets). In a non-exclusive example of a computer game, a game system, or other game mechanism incorporating method 62 (e.g., electronic game system 200), the initial images may be stored in a database and displayed on the display screen at the initiation of method 62. The initial images may correspond to specific words also stored or cataloged in the database, such that when a particular word is provided to the first player in step 22, a specific initial image is also provided to the first player in step 64. Additionally or alternatively, the initial image may be provided to the first player irrespective of the word provided in step 22. For example, the initial image may be randomly determined (or least arbitrarily) from a database of multiple initial images. Additionally or alternatively, initial images may be provided based on a predetermined level of difficulty of a particular instance of playing method 62.

Figure 8:
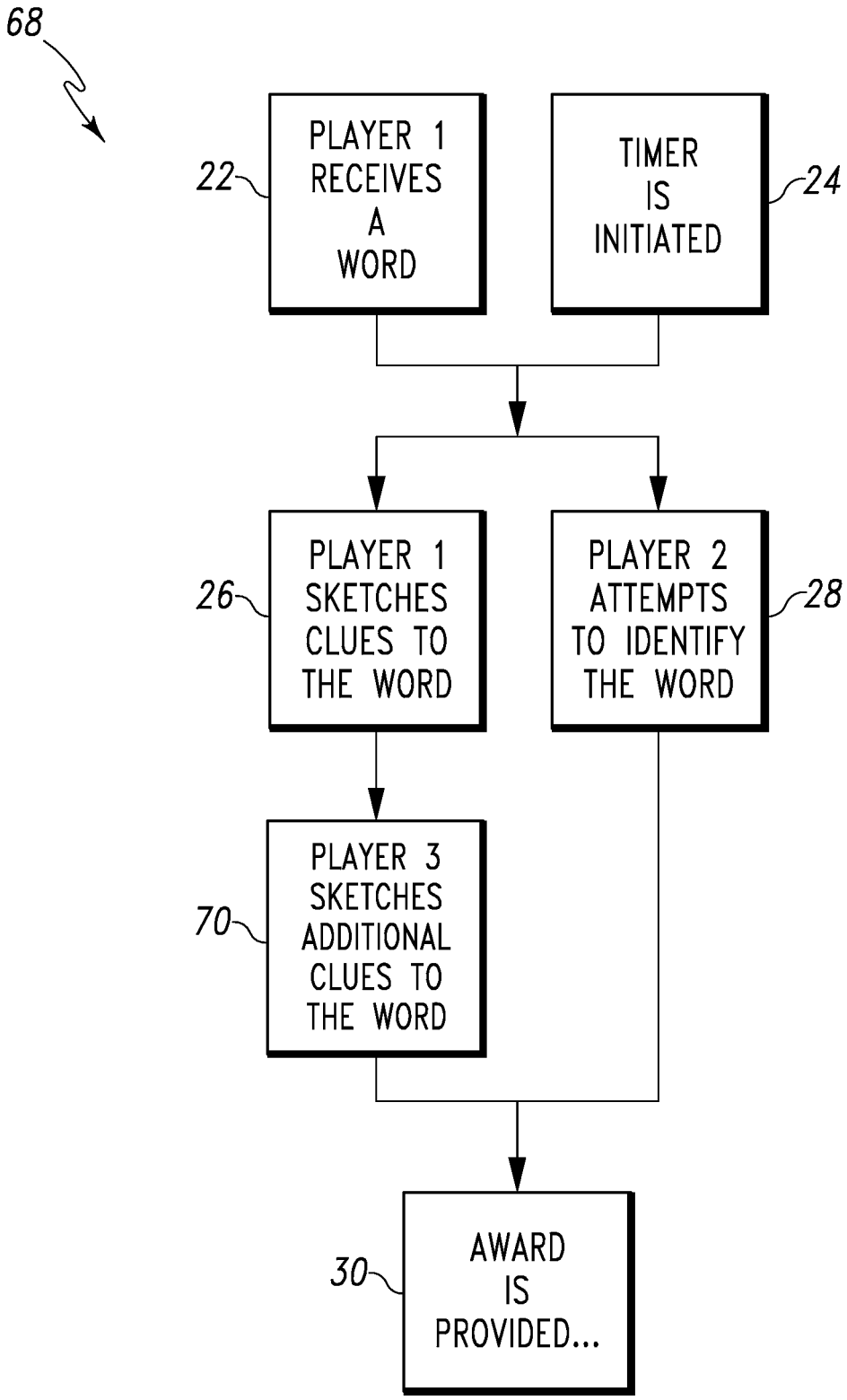
FIG. 8 is a flow chart illustrating at least another method of playing a drawing game.

A tenth method of playing drawing games 68 is generally represented by the flow chart in FIG. 8. Method 68 incorporates steps 22, 24, 26, 28, and 30 as discussed above; however, method 68 further includes a step 70 at which point a third player sketches additional clues to the word to create a second drawing incorporating the first drawing sketched by the first player. While the third player sketches clues to the word, the second player observes the second drawing and continues to attempt to identify the word. The first player may pass the appropriate mechanism (paper tablet and writing utensil or drawing input device depending on the particular embodiment of game incorporating method 68) to the third player after a predetermined time, after an arbitrary time, or after a time chosen by the players, for example, when the first player is stumped as to what clues he or she should sketch or when the third player indicates that he or she is ready to sketch clues. Any determination of when step 70 is initiated is within the scope of the present disclosure.

The award of step 30 of method 68 may simply be based on whether the second player correctly identifies the word before the timer runs to a predetermined time as discussed above. Additionally or alternatively, however, the award of method 68 may at least in part be further based on whether or not the second player correctly identifies the word before the first player passes the appropriate mechanism to the third player, the length of time the first player spends sketching clues to the word, the length of time the third player spends sketching clues to the word, or any other variation of the various characteristics of method 68 as may be suitable.

Figure 9:
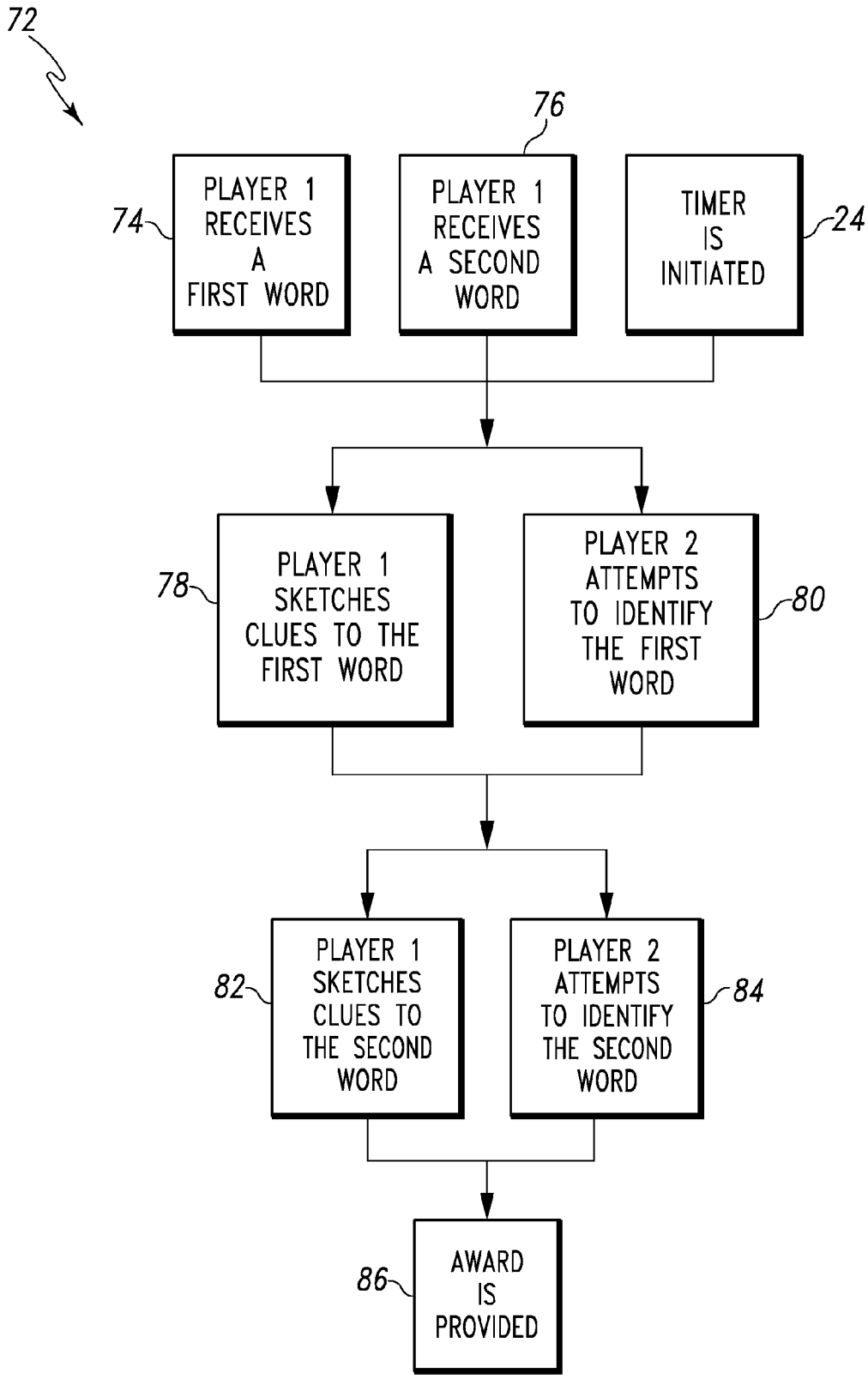
FIG. 9 is a flow chart illustrating at least another method of playing a drawing game.

An eleventh method of playing drawing games 72 is generally represented by the flow chart in FIG. 9. Method 72 includes the steps of: providing a first word to a first player, as indicated at 74; providing a second word to the first player, as indicated at 76; initiating a timer, as indicated at 24; sketching, by the first player, clues to the first word to create a first drawing, as indicated at 78; attempting, by a second player observing the first drawing, to identify the first word, as indicated at 80; upon the second player correctly identifying the first word, sketching, by the first player, clues to the second word to create a second drawing, as indicated at 82; attempting, by the second player observing the second drawing, to identify the second word, as indicated at 84; and providing an award based at least in part on whether the second player correctly identifies the first word and the second word before the timer runs to a predetermined time, as indicated at 86.

Method 72 is distinguished from method 46 represented in FIG. 5, in that in method 72, the second word is provided contemporaneous with the providing of the first word rather than only after the first player has sketched clues to the first word. Method 72 is further distinguished in that the first player may not begin sketching clues to the second word until after the second player has correctly identified the first word.

Method 72 is not limited to providing only two words to the first player, and it may be implemented with any number of words greater than one. For example, a non-exclusive example of an implementation of method 72 corresponds to the providing of a three word phrase. In such example, the first player must begin with sketching clues to the first word of the phrase and may only begin to sketch clues to the second word of the phrase once the second player correctly identifies the first word. Likewise, the first player may only begin sketching clues to the third word of the phrase once the second player correctly identifies the second word.

Figure 10:
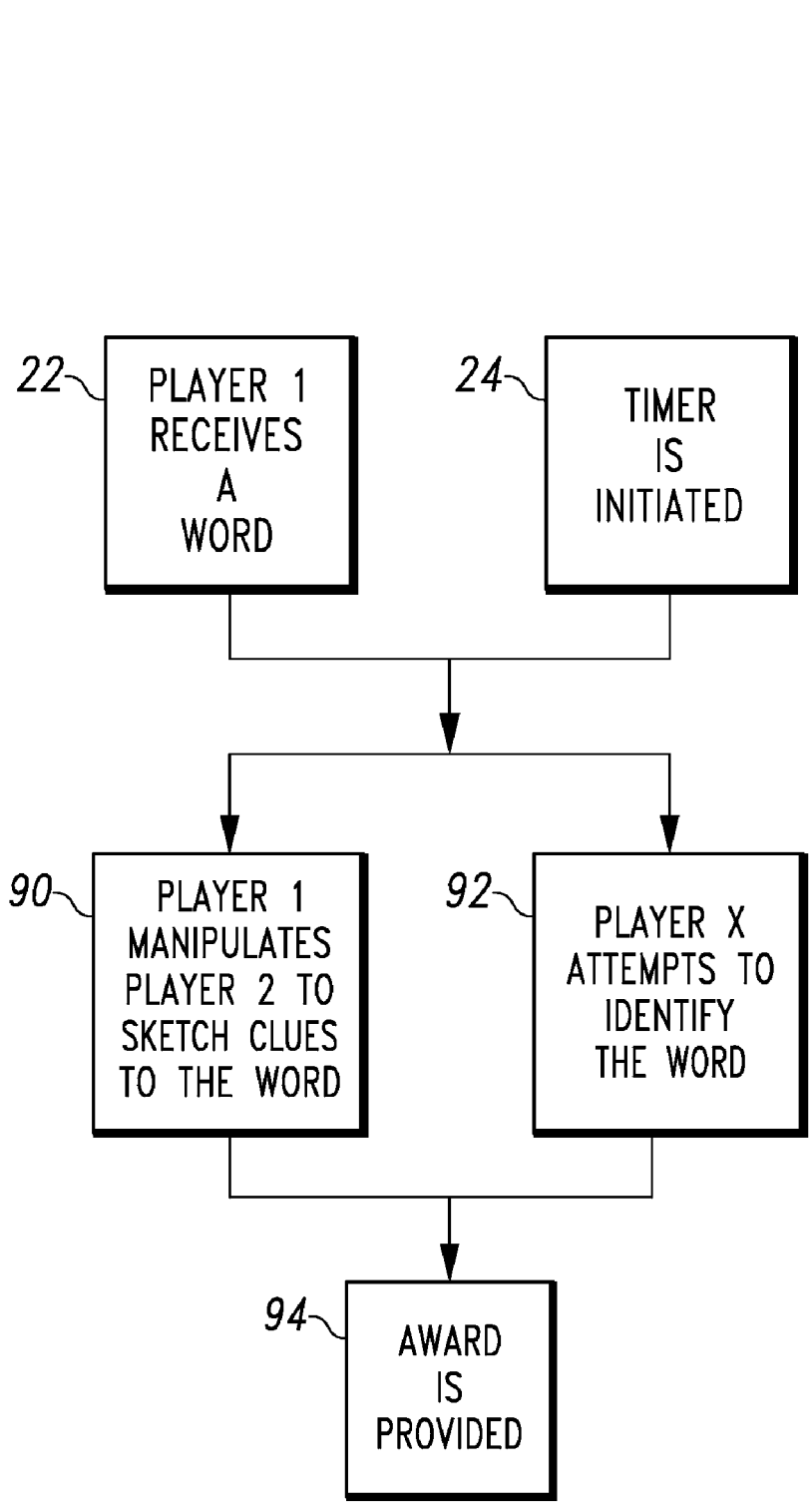
FIG. 10 is a flow chart illustrating at least another method of playing a drawing game.

A twelfth method of playing drawing games 88 is generally represented by the flow chart in FIG. 10. Method 88 includes the steps of: providing a word to a first player, as indicated 22; initiating a timer, as indicated at 24; sketching, by the first player manipulating a hand, wrist, or arm of a second player, clues to the word to create a drawing, as indicated at 90; attempting, by another player observing the drawing, to identify the word, as indicated at 92; and providing an award based at least in part on whether the other player correctly identifies the word before the timer runs to a predetermined time, as indicated at 94. Therefore, though the first player is the one who is provided the word, the second player is the one actually holding the writing utensil (or other drawing input mechanism depending on the particular embodiment of game incorporating method 88). The first player then physically manipulates the hand, wrist, or arm of the second player to create the drawing.

The other player attempting to identify the word in step 92, may be the second player whose hand, wrist, or arm it is being manipulated, or it may be a player other than the second player, or it may be more than one player either including or not including the second player. It may be particularly enjoyable for the players if the second player is the one, or at least one of the ones, attempting to identify the word.

The above disclosed methods of playing drawing games have been disclosed with preferred steps; however, the specific combination of the various steps disclosed and illustrated herein are not to be considered in a limiting sense, as numerous variations are possible. The subject matter of the methods includes all novel and non-obvious combinations and subcombinations of the various steps and elements of the steps. Similarly, where the steps recite "a" or "a first" element or step, or the equivalent thereof, such elements or steps should be understood to include incorporation of one or more such elements or steps, neither requiring nor excluding two or more such elements or steps. For example, in a method that includes a step of providing a word to a first player, more than one word may be provided to the first player (for example in the form of a phrase including any number of words). Correspondingly, in a subsequent step of providing an award based at least in part on whether the second player correctly identifies the word, the second player may be required to identify more than one word in instances where more than one word was provided to the first player (for example in the form of a phrase).

Also, it is within the scope of the present disclosure that more than a second player (or other appropriately named or numbered player as described above) may attempt to identify the word or words being sketched by the first player. For example, an implementation of the methods of the present disclosure may include a team of more than two players, one of which is the first player as referenced in the methods, while the other team members may attempt to identify the word or words being sketched by the first player.

In addition to the adaptation and incorporation of the PICTIONARY® family of board games and the various methods of playing drawing games according to the present disclosure discussed above, the game systems of the present disclosure may incorporate additional drawing games and/or drawing related activities. For example traditional games including (but not limited to) hangman, mazes, and tic-tac-toe may be adapted and incorporated into the game systems. Also, the game systems may incorporate a free draw application where users may be able to draw freely and have drawings displayed on the video display.

In embodiments of computer games, interactive electronic drawing game systems, and other game systems incorporating the various game methods and functions described herein, users may interact with the game systems and choose particular game modes to play through a series of menus or screens or other method of interaction between users and the game system. The following outline sets out a non-exclusive example of menus and screens that allow users to choose particular game modes and proceed with playing a chosen game mode; however, other schemes of user interaction with a game system may be used and is considered within the scope of the present disclosure.

I. Power Up Screen: When the game system is turned on or the game loaded, players may hear a start-up tune and see a start-up screen which may include graphics, animation, etc. After the start-up screen is displayed, the main menu screen may be displayed.

II. Main Menu Screen: The main menu screen may display the various game modes: for example modes corresponding to the PICTIONARY® family of board games, modes corresponding to the various methods of playing drawing games according to the present disclosure, traditional games, free draw, etc. Players may choose which mode they would like to play. Choosing a mode would then take the players into that mode's menu screen. There may also be a <back> tab on the screen or the drawing input device, or another method of allowing the player to go back to the previous screen. Users may select the <back> tab with the stylus or other input device to navigate back out of a certain mode.

A. PICTIONARY® Mode: Players may choose this mode to play a game corresponding to the adaptation of the PICTIONARY® board game, PICTIONARY® Challenge Edition™ board game, or PICTIONARY JUNIOR® board game.

B. Plus Mode: Players may choose this mode if they would like to play any one of the various methods of playing drawing games according to the present disclosure described above and generally represented by the flow charts in FIGS. 4-10. Players may also play a game based on several rounds of different variations of the various method of playing drawing games.

C. Free Draw Mode: Players may choose this mode if they would like to draw freely and have their drawing displayed on the display screen.

III. PICTIONARY® Menu Screen: This screen may appear if players choose the PICTIONARY® Mode from the Main Menu Screen. On this screen players may decide if they would like to play the adaptations the PICTIONARY® board game, the PICTIONARY® Challenge Edition™ board game, or the PICTIONARY JUNIOR® board game. Once players choose, they may then be asked to enter their team names and the player names for each team. Once this is done, the game may begin. Teams may advance through the virtual game board by winning rounds of a game.

IV. Plus Menu Screen: This Menu may appear when players decide to play one of the various methods of playing drawing games. On this screen players may choose to play one of the variations of the various methods of playing drawing games, or they choose to play a game made up of several of the variations of the various methods of playing drawing games. In the latter case, the game system may randomly pick a different method for each round of play, or alternatively, the players may be permitted to select which variations of the various methods of playing drawing games they wish to play. After a method or method is selected, the system may then prompt the players to enter the team names and the player names for each team. Players may then play alternating rounds of the selected or randomly selected methods until one team maneuvers to the end of the virtual game board first. Teams may advance through the virtual game board by winning rounds of the methods.

V. Free Draw Menu Screen: If players decide to just draw pictures without playing a game, they may pick this mode. From the Free Draw Menu Screen, users may choose a background they would like to draw on. Backgrounds may consist of several different pictures and blank screens of different colors. Once the user has scrolled through the thumbnails of the backgrounds and selected one, that background may then be displayed on the screen and the user may begin drawing. There may be a <reset> tab or other method of allowing the user to clear the screen, as well as an <exit> tab or other method of allowing the user to back out of this mode.

It is believed that the disclosure set forth herein encompasses multiple distinct inventions with independent utility. While each of these inventions has been disclosed in a preferred form, the specific embodiments thereof as disclosed and illustrated herein are not to be considered in a limiting sense as numerous variations are possible. The subject matter of the inventions includes all novel and non-obvious combinations and subcombinations of the various elements, features, functions and/or properties disclosed herein. Similarly, where the claims recite "a" or "a first" element or the equivalent thereof, such claims should be understood to include incorporation of one or more such elements, neither requiring nor excluding two or more such elements.

It is believed that the following claims particularly point out certain combinations and subcombinations of features, functions, elements and/or properties that may be claimed through amendment of the present claims or presentation of new claims in this or a related application. Such amended or new claims, whether they are directed to a different invention or directed to the same invention, whether different, broader, narrower or equal in scope to the original claims, are also regarded as included within the subject matter of the inventions of the present disclosure.

We claim:

1. A method of playing a drawing game, comprising:

providing an electronic game system;

playing a plurality of rounds in order to determine a winner of the drawing game, wherein the successful completion of a predetermined amount of rounds of the plurality of rounds determines the winner of the drawing game;

playing at least a first round of the drawing game, the first round comprising the steps of:

providing a word to a first player;

initiating a timer of the electronic game system;

sketching, by the first player after initiation of the timer, clues to the word by providing sequential inputs on a drawing input device of the electronic game system to create portions of a drawing on a display of the electronic game system while a second player by observing the drawing on the display, attempts to identify the word, wherein the electronic game system begins to erase the portions of the drawing on the display corresponding to the sequential inputs in the order in which said sequential inputs were provided, after a first predetermined time period after initiation of the timer; and providing an award based at least in part on whether the second player correctly identifies the word before the timer runs to a second predetermined time period, after initiation of the timer, wherein the first predetermined time period is less than the second predetermined time period, and wherein the award is used to determine if the first round has been successfully completed and therefore one of the predetermined amount of rounds of the plurality of rounds has been successfully completed.

2. A method of playing a drawing game as in claim 1, wherein the method further comprises:

playing a second round of the drawing game, the second round comprising:

providing a word to a first player;

initiating a timer of the electronic game system;

sketching, by the first player, upside-down clues to the word by providing inputs on the drawing input device of the electronic game system to create a drawing on the display of the electronic game system while a second player by observing the drawing on the display, attempts to identify the word; and providing an award based at least in part on whether the second player correctly identifies the word before the timer runs to a predetermined time period after initiation of the timer during the second round, wherein the award is used to determine if the second round has been successfully completed and therefore one of the predetermined amount of rounds of the plurality of rounds has been successfully completed.

3. A method of playing a drawing game as in claim 2, wherein the method further comprises:

playing a third round of the drawing game, the third round comprising:

providing a word to a first player;

initiating a timer of the electronic game system;

sketching, by the first player manipulating a hand, wrist, or arm of a second player, clues to the word by providing inputs on the drawing input device of the electronic game system to create a drawing on the display while the second player or a third player, observing the drawing, attempts to identify the word; and providing an award based at least in part on whether the third player correctly identifies the word before the timer runs to a predetermined time period after initiation of the timer during the third round, wherein the award is used to determine if the third round has been successfully completed and therefore one of the predetermined amount of rounds of the plurality of rounds has been successfully completed.

4. A method of playing a drawing game as in claim 3, wherein the method further comprises:

playing a fourth round of the drawing game, the fourth round comprising:

providing a word to a first player;

initiating a timer of the electronic game system;

sketching, by the first player, clues to the word by providing inputs on the drawing input device of the electronic game system to create a first drawing on the display while a second player, observing the first drawing, attempts to identify the word;

sketching, by a third player, additional clues to the word by providing inputs on the drawing input device of the electronic game system to create a second drawing incorporating the first drawing on the display while the second player, observing the second drawing, attempts to identify the word; and providing an award based at least in part on whether the second player correctly identifies the word before the timer runs to a predetermined time period after initiation of the timer during the fourth round, wherein the award is used to determine if the fourth round has been successfully completed and therefore one of the predetermined amount of rounds of the plurality of rounds has been successfully completed; and playing a fifth round of the drawing game, the fifth round comprising:

providing a first word and a second word to a first player;

initiating a timer of the electronic game system;

sketching, by the first player, clues to the first word by providing inputs on the drawing input device of the electronic game system to create a first drawing on the display while a second player, observing the first drawing on the display, attempts to identify the first word wherein and upon the second player correctly identifying the first word, sketching, by the first player, clues to the second word by providing inputs on the drawing input device of the electronic game system to create a second drawing on the display while the second player, observing the second drawing on the display, attempts to identify the second word; and providing an award based at least in part on whether the second player correctly identifies the first word and the second word before the timer runs to a predetermined time period after initiation of the timer during the fifth round, wherein the award is used to determine if the fifth round has been successfully completed and therefore one of the predetermined amount of rounds of the plurality of rounds has been successfully completed.

5. The method of claim 4, wherein the display is a video display and the drawing input device is configured to convert the inputs on the drawing input device into video signals for display on the video display.

6. The method of claim 5, wherein the drawing input device includes a tablet and stylus.

7. The method as in claim 1, further comprising providing an award based at least in part on whether the second player correctly identifies the word before any portion of the drawing is erased.

8. The method as in claim 1, further comprising:

converting the inputs on the drawing input device into a plurality of line segments to be drawn on the display, wherein each of the plurality of line segments are sequentially displayed on the display in the order in which the inputs were converted into the plurality of line segments and each of the plurality of line segments are then sequentially erased from the display in the order in which they were displayed on the display, after expiration of the first predetermined time period.

9. The method as in claim 1, wherein the drawing is erased by the electronic game system at any one of; a uniform rate with respect to a time period, an increasing rate with respect to a time period, a decreasing rate with respect to a time period or an arbitrarily changing rate with respect to a time period.

10. A method of playing a drawing game, comprising:

initiating a timing device of an electronic game system of the drawing game;

sketching, by a first player after initiating of the timing device, clues to a word previously provided to the first player by providing inputs on a drawing input device of the electronic game system, wherein the inputs are converted into portions of a drawing visually perceivable on a display of the electronic game system, the display being coupled to the drawing input device;

erasing portions of the drawing from the display in sequence to how the drawing was drawn after a first predetermined time period has elapsed after initiation of the timing device, wherein the step of erasing portions of the drawing is performed by the electronic game system; and providing an award based at least in part on whether a second player observing the display correctly identifies the word before a second predetermined time period elapses after initiation of the timing device, wherein the first predetermined time period is less than the second predetermined time period; and determining a winner of the drawing game when a predetermined amount of awards have been accumulated by a player of the drawing game.

11. The method as in claim 10, further comprising:

converting the inputs on the drawing input device into a plurality of line segments for display on the display, wherein the plurality of line segments depict the drawing displayed on the display and wherein each of the plurality of line segments are each individually erased from the display by the electronic game system after the first predetermined time period has elapsed after initiation of the timing device, wherein a first of the plurality of line segments displayed on the display is erased first when the first predetermined time period elapses.

12. The method as in claim 11, further comprising providing an award based at least in part on whether the second player correctly identifies the word before any portion of the drawing is erased from the display.

13. The method as in claim 11, further comprising providing an award based at least in part on whether the second player correctly identifies the word before the drawing is completely erased from the display.

14. The method as in claim 13, wherein the drawing input device further comprises a tablet and a stylus, the stylus being configured to provide the inputs to the tablet and the award is a number of spaces a game piece may be moved on a game board wherein the winner of the game is determined by moving the game piece a predetermined number of spaces on the game board.

15. The method as in claim 10, wherein the display is a video display and the method further comprises:

providing an award based at least in part on whether the second player correctly identifies the word before any portion of the drawing is erased from the display.

16. The method as in claim 10, further comprising:

converting the inputs on the drawing input device into a plurality of line segments on the display, wherein the plurality of line segments depict the drawing; and determining a value of the award based upon the number of the plurality of line segments displayed on the display when the second player correctly identifies the word.

17. The method as in claim 16, further comprising:

determining the number of the plurality of line segments by adding each end point of each of the plurality of line segments to provide a sum and dividing the sum in half.

18. The method as in claim 10, wherein the drawing is erased from the display at any one of; a uniform rate with respect to a time period, an increasing rate with respect to a time period, a decreasing rate with respect to a time period or an arbitrarily changing rate with respect to a time period.

19. The method as in claim 18, wherein the drawing input device comprises a tablet and stylus.

20. A method of playing a drawing game, comprising:

initiating a timing device of an electronic game system of the drawing game;

sketching, by a first player, after initiating the timing device clues to a first word previously provided to the first player by providing inputs on a drawing input device of the electronic game system, wherein the inputs are converted into portions of a drawing visually perceivable on a display of the electronic game system coupled to the drawing input device;

erasing the portions of the drawing from the display in sequence to how the drawing was drawn after a first predetermined time period has elapsed after initiation of the timing device, and wherein the step of erasing portions of the drawing is performed by the electronic game system;

sketching, by the first player, clues to a second word previously provided to the first player by providing inputs corresponding to the second word on the drawing input device of the electronic game system, wherein the inputs corresponding to the second word are converted into portions a drawing visually perceivable on the display only if the second player correctly identifies the first word before a second predetermined time period after initiation of timing device elapses, the second predetermined time period being greater than the first predetermined time period;

erasing the portions of the drawing relating to the clues of the second word from the display in sequence to how the drawing was drawn after the first predetermined time period has elapsed after initiation of the timing device, wherein the step of erasing the portions of the drawing is performed by the electronic game system;

providing an award based at least in part on whether the second player correctly identifies the first word and the second word before the second predetermined time period elapses; and determining a winner of the drawing game when a predetermined amount of awards have been accumulated by a player of the drawing game.

* * * * *